US011987888B2

(12) United States Patent
Iwanaga et al.

(10) Patent No.: US 11,987,888 B2
(45) Date of Patent: May 21, 2024

(54) TRIVALENT CHROMIUM CHEMICAL CONVERSION TREATMENT LIQUID FOR ZINC OR ZINC ALLOY BASE AND CHEMICAL CONVERSION TREATMENT METHOD USING THE SAME

(71) Applicant: DIPSOL CHEMICALS CO., LTD., Tokyo (JP)

(72) Inventors: Ryouji Iwanaga, Chiba (JP); Manabu Inoue, Tokyo (JP); Tomitaka Yamamoto, Tokyo (JP); Takahiro Fujino, Tokyo (JP)

(73) Assignee: Dipsol Chemicals Co., Ltd., Tokyo (JP)

( * ) Notice: Subject to any disclaimer, the term of this patent is extended or adjusted under 35 U.S.C. 154(b) by 0 days.

(21) Appl. No.: 17/888,926

(22) Filed: Aug. 16, 2022

(65) Prior Publication Data

US 2022/0396884 A1 Dec. 15, 2022

Related U.S. Application Data

(63) Continuation of application No. 16/126,461, filed on Sep. 10, 2018, now abandoned.

(30) Foreign Application Priority Data

Sep. 14, 2017 (JP) ..... 2017-177016

(51) Int. Cl.
*C23C 22/30* (2006.01)
*C23C 22/34* (2006.01)
(Continued)

(52) U.S. Cl.
CPC ..... *C23C 22/53* (2013.01); *C23C 22/34* (2013.01); *C23C 2222/10* (2013.01)

(58) Field of Classification Search
CPC ..... C23C 2222/10; C23C 22/30; C23C 22/34; C23C 22/361
See application file for complete search history.

(56) References Cited

U.S. PATENT DOCUMENTS

2003/0148122 A1 8/2003 Oshima et al.
2005/0103403 A1 5/2005 Oshima et al.
(Continued)

FOREIGN PATENT DOCUMENTS

EP 3 301 205 4/2018
JP H07-011454 A 1/1995
(Continued)

OTHER PUBLICATIONS

Final Office Action on U.S. Appl. No. 16/126,461 dated Nov. 26, 2021 (8 pages).
(Continued)

*Primary Examiner* — Lois L Zheng
(74) *Attorney, Agent, or Firm* — Foley & Lardner LLP

(57) ABSTRACT

An object is to provide a trivalent chromium chemical conversion treatment liquid for a zinc or zinc alloy base capable of forming an environmentally-friendly chemical conversion coating with high corrosion resistance. The present invention provides a hexavalent chromium-free trivalent chromium chemical conversion treatment liquid for zinc or zinc alloy, the liquid comprising trivalent chromium ions, zirconium ions, nitrate ions, and chain colloidal silica, in which the pH of the treatment liquid is 2.5 to 5.0.

15 Claims, 1 Drawing Sheet

(51) Int. Cl.
*C23C 22/53* (2006.01)
*C23C 22/00* (2006.01)

(56) References Cited

U.S. PATENT DOCUMENTS

| | | | | |
|---|---|---|---|---|
| 2008/0213610 | A1* | 9/2008 | Idei | F16D 65/12 428/548 |
| 2010/0230009 | A1 | 9/2010 | Oshima et al. | |
| 2010/0239773 | A1 | 9/2010 | Yamaguchi et al. | |
| 2015/0135988 | A1 | 5/2015 | Yamaguchi | |
| 2019/0136383 | A1 | 5/2019 | Saito et al. | |

FOREIGN PATENT DOCUMENTS

| | | | | | |
|---|---|---|---|---|---|
| JP | 2002-069660 | | * | 3/2002 | C23C 22/53 |
| JP | 2003-166074 | A | | 6/2003 | |
| JP | 2015-038255 | A | | 2/2015 | |
| KR | 20090048495 | A | | 5/2009 | |
| KR | 20170085587 | A | | 7/2017 | |
| WO | WO-2016/104703 | | | 6/2016 | |

OTHER PUBLICATIONS

Korean Office Action, issued in Korean Pat. App. No. 10-2018-0095569, 10 pages (Dec. 11, 2019).
Non-Final Office Action on U.S. Appl. No. 16/126,461 DTD Jun. 3, 2021.
Non-Final Office Action on U.S. Appl. No. 16/126,461 DTD Dec. 30, 2020.

* cited by examiner

| TYPE | CONVENTIONAL | HIGHLY CORROSION RESISTANT |
|---|---|---|
| SILICA | SPHERICAL COLLOIDAL SILICA (GENERAL) PARTICLE SIZE : 10～20 nm | CHAIN COLLOIDAL SILICA PARTICLE SIZE : 60～80 nm |
| IMAGE ILLUSTRATION | 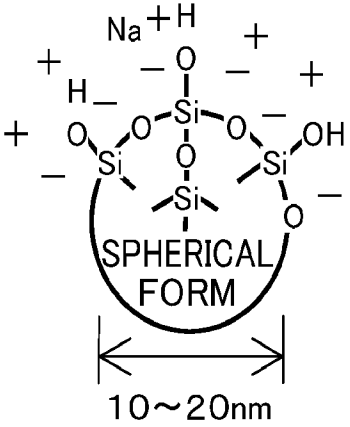  | 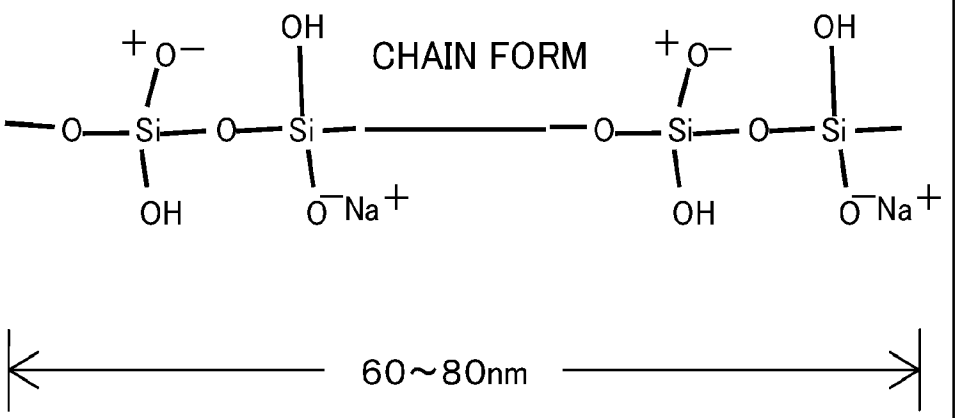  |

TRIVALENT CHROMIUM CHEMICAL CONVERSION TREATMENT LIQUID FOR ZINC OR ZINC ALLOY BASE AND CHEMICAL CONVERSION TREATMENT METHOD USING THE SAME

CROSS-REFERENCE TO RELATED APPLICATIONS

This application is a continuation of U.S. patent application Ser. No. 16/126,461, filed Sep. 10, 2018, which claims the benefit of and priority to Japanese Patent Application No. 2017-177016, filed on Sep. 14, 2017, all of which are hereby incorporated by reference in their entireties.

TECHNICAL FIELD

The present invention relates to a novel chemical conversion treatment liquid for forming a silver-white chemical coating finished with uniform and haze-free (white haze-free) appearance and having excellent corrosion resistance on the surface of a zinc or zinc alloy metal, and relates to a chemical conversion treatment method using the same.

BACKGROUND ART

Chemical conversion treatment is a technique that has been used from old times to impart corrosion resistance to metal surfaces, and is also currently used for surface treatment for aircraft, construction materials, automobile parts, and the like. However, the coating of chemical conversion treatment represented by the chromic acid, chromate chemical conversion treatment partly contains harmful hexavalent chromium.

The hexavalent chromium is subject to restrictions by WEEE (Waste Electrical and Electronic Equipment) Directive and RoHS (Restriction of Hazardous Substances) Directive, ELV (End of Life Vehicles) Directive, and the like. For this reason, chemical conversion treatment liquids using trivalent chromium instead of hexavalent chromium have been extensively studied and industrialized (Japanese Patent Application Publication No. 2003-166074). The trivalent chromium chemical conversion treatment liquid not containing hexavalent chromium, in particular, often uses a cobalt compound in order to enhance corrosion resistance. The cobalt is one of so-called rear metals, and is not actually supplied in the stable supply system for the reasons such as expansion of a range of applications and limited production countries. Meanwhile, cobalt chloride, cobalt sulfate, cobalt nitrate, and cobalt carbonate also fall under SVHC (Substances of Very High Concern) specified by the REACH (Registration, Evaluation, Authorization and Restriction of Chemicals) regulation. Hence, there is movement to restrict use of these substances.

CITATION LIST

Patent Literature

[Patent Literature 1] Japanese Patent Application Publication No. 2003-166074

[Patent Literature 2] Japanese Patent Application Publication No. H07-11454

SUMMARY

Technical Problems

In view of the aforementioned circumstances, the present invention has an object to provide a trivalent chromium chemical conversion treatment liquid for a zinc or zinc alloy base, the liquid being capable of forming an environmentally-friendly chemical conversion coating with high corrosion resistance. The present invention has another object to provide a trivalent chromium chemical conversion treatment liquid capable of making zinc plating achieve high corrosion resistance comparable to that of zinc nickel alloy plating and forming a well-finished appearance without white haze.

Solution to Problems

As a result of earnest studies to achieve these two objects, the present inventors completed the present invention by finding that a trivalent chromium chemical conversion treatment liquid which contains trivalent chromium ions without containing hexavalent chromium and which is capable of forming, on zinc and zinc ally surfaces, environmentally-friendly white-silver chemical conversion coatings having excellent corrosion resistance and finished with uniform appearance without white haze can be obtained by: causing the chemical conversion treatment liquid to contain chain colloidal silica together with zirconium ions and nitrate ions; and adjusting the pH of the chemical conversion treatment liquid within a particular pH range.

In other words, the present invention provides a hexavalent chromium-free trivalent chromium chemical conversion treatment liquid for a zinc or zinc alloy base, the treatment liquid comprising trivalent chromium ions, zirconium ions, nitrate ions, and chain colloidal silica, and having a pH of 2.5 to 5.0.

In addition, the present invention provides a chemical conversion treatment method comprising brining the chemical conversion treatment liquid into contact with a zinc or zinc alloy base.

Advantageous Effect of the Invention

According to the present invention, it is possible to provide a trivalent chromium chemical conversion treatment liquid for a zinc or zinc alloy base capable of forming an environmentally-friendly chemical conversion coating achieving excellent corrosion resistance even without containing hexavalent chromium and cobalt, and finished with silver-white uniform appearance without white haze.

BRIEF DESCRIPTION OF THE DRAWING

FIG. 1 is a diagram illustrating chain colloidal silica and spherical colloidal silica.

DESCRIPTION OF EMBODIMENTS

A base material used in the present invention is not particularly limited, but may be any material whose surface can be coated with zinc or a zinc alloy. Examples of the base material are various metals such as iron, nickel, and copper, alloys thereof, or metals and alloys such as aluminum treated with zinc substitution, and have various shapes such as a plate-like shape, a rectangular parallelepiped, a column, a cylinder, and a spherical shape. A specific example is a disc brake caliper.

The aforementioned base material is plated with zinc or a zinc alloy by a conventional method. The zinc plating may be deposited on the base material by using an acidic/neutral bath such as a sulfuric acid bath, a fluoroborate bath, a potassium chloride bath, a sodium chloride bath, and an ammonium chloride eclectic bath, or an alkaline bath such as a cyan bath, a zincate bath, and a pyrophosphoric acid bath. A preferable bath is an acidic bath. In addition, the zinc alloy plating may be deposited in any alkaline bath such as an ammonium chloride bath and an organic chelate bath.

Then, as the zinc alloy plating, there are zinc-iron alloy plating, zinc-nickel alloy plating, zinc-cobalt alloy plating, tin-zinc alloy plating, and so on. Preferable alloy plating is zinc-nickel alloy plating. The zinc or zinc alloy plating deposited on the base material can have any thickness, which may be 1 μm or more, and preferably 5 to 25 μm.

In the present invention, zinc or zinc alloy plating is deposited on the base material in the aforementioned way, then appropriate pretreatment is carried out as needed such as water washing or water washing followed by activation treatment by nitric acid, and thereafter chemical conversion treatment is carried out in a method such as dipping treatment using a trivalent chromium chemical conversion treatment liquid for a zinc or zinc alloy base of the present invention.

The trivalent chromium chemical conversion treatment liquid of the present invention does not substantially contain hexavalent chromium ions but contains trivalent chromium ions, zirconium ions, nitrate ions and chain colloidal silica, and the pH of the treatment liquid is 2.5 to 5.0.

A trivalent chromium compound that provides the trivalent chromium ions is not particularly limited, but is preferably water-soluble. Examples of the trivalent chromium compound include trivalent chromium salts such as chromium chloride, chromium sulfate, chromium nitrate, chromium phosphate, and chromium acetate. Instead, hexavalent chromium ions of a chromate or dichromate may be reduced to trivalent chromium ions with a reducing agent. These trivalent chromium compounds may be used singly or in combination of two or more kinds. The content of trivalent chromium ions in the treatment liquid is 2 to 200 mmol/L, preferably 5 to 100 mmol/L, and more preferably 10 to 80 mmol/L. By setting the content of trivalent chromium ions in such a range, excellent corrosion resistance can be obtained. In addition, in the present invention, use of trivalent chromium at such a low concentration range is advantageous from the viewpoint of waste water treatment and an economic viewpoint.

A zirconium compound that provides the zirconium ions is not particularly limited, but is preferably water-soluble. Examples of the zirconium compound include: inorganic zirconium compounds or salts thereof such as zirconium nitrate, zirconium oxynitrate, zirconium nitrate ammonium, zirconyl chloride, zirconyl sulfate, zirconium carbonate, zirconyl carbonate ammonium, zirconyl potassium carbonate, zirconyl sodium carbonate, zirconyl lithium carbonate, and zirconium hydrofluoric acid ($H_2ZrF_6$) and salts thereof (for example, a sodium salt, a potassium salt, a lithium salt, and an ammonium salt); and organic zirconium compounds such as zirconyl acetate, zirconium lactate, zirconium tartrate, zirconium malate, and zirconium citrate. Preferable zirconium compounds are a zirconium hydrofluoric acid ($H_2ZrF_6$) and salts thereof, for example, a sodium salt, a potassium salt, a lithium salt and an ammonium salt [$(NH_4)_2ZrF_6$] of the zirconium hydrofluoric acid ($H_2ZrF_6$). These zirconium compounds may be used singly or in combination of two or more kinds. The content of zirconium ions in the treatment liquid is 1 to 300 mmol/L, preferably 2 to 150 mmol/L, and more preferably 5 to 50 mmol/L. By setting the content of zirconium ions in such a range, excellent corrosion resistance can be obtained.

Moreover, in the present invention, a molar ratio of trivalent chromium ions to zirconium ions (trivalent chromium ions/zirconium ions) is preferably 0.1 to 4, more preferably 0.2 to 3.5, and even more preferably 0.3 to 3. By setting the molar ratio of trivalent chromium ions to zirconium ions in such a range, a chemical conversion coating with excellent appearance and corrosion resistance can be obtained.

A nitric acid compound that provides the nitrate ions is not particularly limited, but is preferably water-soluble. Examples of the nitric acid compound include nitric acid, ammonium nitrate, sodium nitrate, potassium nitrate, lithium nitrate, and the like. These nitric acid compounds may be used singly or in combination of two or more kinds. The content of nitrate ions in the treatment liquid is 30 to 400 mmol/L, preferably 40 to 300 mmol/L, and more preferably 50 to 200 mmol/L. By setting the content of nitrate ions in such a range, excellent appearance and corrosion resistance can be obtained.

In the present invention, as depicted in FIG. 1, the chain colloidal silica is chain colloidal silica in which several to dozen primary particles of the colloidal silica are linked in a chain form unlike spherical colloidal silica which is usually used. The chain colloidal silica may be in a linear chain or branched chain. The average particle size of the primary particles of the colloidal silica is preferably 5 to 20 nm, and more preferably 10 to 15 nm. In the chain colloidal silica, primary particles are bound preferably in a link having a length of 20 to 200 nm, and more preferably in a link having a length of 40 to 100 nm. Here, the length of the chain colloidal silica is the total length of the length of the main chain and the length of the branched chain. The size of the chain colloidal silica is 20 to 200 nm in length. These kinds of chain colloidal silica may be used singly or in combination of two or more kinds. The concentration of the chain silica is 25 to 600 mmol/L, preferably 30 to 450 mmol/L, and more preferably 40 to 300 mmol/L. By setting the content of the chain colloidal silica in such a range, excellent appearance and corrosion resistance can be obtained. Such chain colloidal silica is commercially available. For example, there are ST-UP and ST-OUP manufactured by Nissan Chemical Industries, Ltd., and so on.

The trivalent chromium chemical conversion treatment liquid for a zinc or zinc alloy base of the present invention can form a coating with excellent corrosion resistance on the surface of zinc or zinc alloy plating even without containing cobalt ions. However, the treatment liquid may further contain cobalt ions. In the case where cobalt ions are contained, the content thereof is preferably 300 mmol/L or less, more preferably 100 mmol/L or less, and even more preferably 50 mmol/L or less. A cobalt compound that provides cobalt ions is not particularly limited but is preferably water-soluble. Examples of the cobalt compound are cobalt nitrate, cobalt chloride, cobalt sulfate, and the like. These cobalt compounds may be used singly or in combination of two or more kinds.

The trivalent chromium chemical conversion treatment liquid for a zinc or zinc alloy base of the present invention may further contain fluoride ions. The content of fluoride ions is preferably 6 to 1800 mmol/L, and more preferably 30 to 300 mmol/L. The fluoride ion serves as a counter ion of the zirconium ion, and the fluoride ions with the content set in such a range can stabilize the zirconium ions.

A fluorine-containing compound that provides the fluoride ions is not particularly limited. Examples of the fluorine-containing compound include hydrofluoric acid, fluoroboric acid, ammonium fluoride, and zirconium hexafluorozirconic acid or a salt thereof, and the hexafluorohydroconic acid or the salt thereof is preferable. These fluorine-containing compounds may be used singly or in combination of two or more kinds.

The trivalent chromium chemical conversion treatment liquid for a zinc or zinc alloy base of the present invention may further contain a water-soluble carboxylic acid or a salt thereof. The content of the water-soluble carboxylic acid or the salt thereof is preferably 0.1 g/L to 10 g/L, more preferably 0.5 g/L to 8 g/L, and even more preferably 1 g/L to 5 g/L. The water-soluble carboxylic acid or the salt thereof with the content set in such a range can stabilize the trivalent chromium ions by forming a complex with the trivalent chromium ions. Preferably, the molar ratio of the trivalent chromium ions to the water-soluble carboxylic acid or the salt thereof is 0.5 to 1.5, both inclusive.

The water-soluble carboxylic acid is not particularly limited. Examples thereof include dicarboxylic acids, which can be represented by $R_1$— $(COOH)_2$ [$R_1$=$C_0$ to $C_8$], such as oxalic acid, malonic acid, succinic acid, glutaric acid, adipic acid, and suberic acid, and the oxalic acid and malonic acid where $R_1$=$C_0$ and $C_1$, respectively, are preferred. Examples of the salt of the water-soluble carboxylic acid include salts of alkali metals such as potassium and sodium, salts of alkaline earth metals such as calcium and magnesium, and ammonium salts. These water-soluble carboxylic acids or salts thereof may be used singly or in combination of two or more kinds.

The trivalent chromium chemical conversion treatment liquid for a zinc or zinc alloy base of the present invention may further contain a water-soluble metal salt containing a metal selected from the group consisting of Zn, Al, Ti, Mo, V, Ce, and W.

An example of the water-soluble metal salt is $K_2TiF_6$ or the like. These water-soluble metal salts may be used singly or in combination of two or more kinds. The content of the water-soluble metal salt is preferably 0.1 g/L to 1.5 g/L, and more preferably 0.2 g/L to 1.0 g/L.

The trivalent chromium chemical conversion treatment liquid for a zinc or zinc alloy base of the present invention may further contain a phosphorus compound.

An example of the phosphorus compound is $NaH_2PO_2$ (sodium hypophosphite) or the like. These phosphorus compounds may be used singly or in combination of two or more kinds. The content of the phosphorus compound is preferably 0.01 g/L to 1.0 g/L, and more preferably 0.1 g/L to 0.5 g/L.

The trivalent chromium chemical conversion treatment liquid for a zinc or zinc alloy base of the present invention has a pH in a range of 2.5 to 5.0, preferably a range of 3.0 to 4.5, and more preferably a range of 3.0 to 4.0. In order to adjust the pH within such a range, it is possible to use an inorganic acid such as hydrochloric acid or nitric acid, an organic acid, or an alkaline agent such as ammonia, ammonium salt, caustic alkali, sodium carbonate, potassium carbonate, or ammonium carbonate. By setting the pH within such a range, excellent appearance and corrosion resistance can be obtained.

In the trivalent chromium chemical conversion treatment liquid for a zinc or zinc alloy base of the present invention, the residue other than the above components is water.

As a method of forming a trivalent chromium chemical conversion coating on zinc or zinc alloy plating by using the trivalent chromium chemical conversion treatment liquid for a zinc or zinc alloy base of the present invention, any publicly known method not particularly limited can be applied. For example, a method such as dipping may be used to bring the base material plated with zinc or zinc alloy into contact with the chemical conversion treatment liquid. In the case of dipping, the temperature of the chemical conversion treatment liquid during the treatment is preferably 20 to 60° C., and more preferably 30 to 40° C. The dipping period is preferably 5 to 600 seconds, and more preferably 30 to 300 seconds. Here, in order to activate the zinc- or zinc alloy-plated surface, the base material may be dipped into a dilute nitric acid solution (such as 5% nitric acid), a dilute sulfuric acid solution, a dilute hydrochloric acid solution, a dilute hydrofluoric acid solution, or the like before the trivalent chromium chemical conversion treatment. The conditions and treatment operations other than the aforementioned ones may be determined and carried out according to the conventional hexavalent chromate treatment method.

The trivalent chromium chemical conversion coating formed on the zinc or zinc alloy plating by using the trivalent chromium chemical conversion treatment liquid for a zinc or zinc alloy base of the present invention contains trivalent chromium, zirconium, and chain silica, but does not contain hexavalent chromium.

Next, the present invention is described by using Examples and Comparative Examples. The present invention should not be limited to these examples.

EXAMPLES

Examples 1 to 5 and Comparative Examples 1 to 4 used, as a zinc-plated test specimen, a matt steel sheet in size of 0.5×50×70 mm plated with zinc in a zincate bath (NZ-98 manufactured by DIPSOL CHEMICALS Co., Ltd.) in a thickness of 9 to 10 μm. The zinc-plated test specimen was dipped in a 5% nitric acid aqueous solution at room temperature for 10 seconds and then was thoroughly rinsed with running tap water to clean the surface. Next, the zinc-plated test specimen was subjected to the chemical conversion treatment specified below. The test specimen after the chemical conversion treatment was thoroughly washed with tap water and ion exchanged water, and then was placed and dried in an electric drying oven kept at 80° C. for 10 minutes.

Example 1

A chemical conversion treatment liquid was prepared as specified below, and the pH of the liquid was adjusted to 3.7 with ammonia water. Thereafter, the above test specimen was dipped in the chemical conversion treatment liquid at 35° C. for 60 seconds.

(A) 40% chromium nitrate: 5.4 g/L (9 mmol/L in terms of $Cr^{3+}$ ions and 27 mmol/L in terms of $NO_3^-$ ions)

(B) Potassium fluorozirconate: 2.0 g/L (7 mmol/L in terms of Zr ions)

(C) Ammonium nitrate: 4.8 g/L (60 mmol/L in terms of $NO_3^-$ ions)

(D) Chain colloidal silica (diameter of 40-100 nm): 20.0 g/L (50 mmol/L)

The residue is water.

Example 2

A chemical conversion treatment liquid was prepared as specified below, and the pH of the liquid was adjusted to 3.5 with ammonia water. Thereafter, the above test specimen was dipped in the chemical conversion treatment liquid at 45° C. for 40 seconds.

(A) 35% chromium chloride: 9.0 g/L (20 mmol/L in terms of $Cr^{3+}$ ions)

(B) 40% zirconium fluoride: 7.8 g/L (15 mmol/L in terms of Zr ions)

(C) Sodium nitrate: 7.2 g/L (85 mmol/L in terms of $NO_3^-$ ions)

Zinc nitrate hexahydrate: 0.75 g/L (5 mmol/L in terms of $NO_3^-$ ions)

(D) Chain colloidal silica (diameter of 40-100 nm): 40.0 g/L (100 mmol/L)

The residue is water.

Example 3

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium sulfate: 8.8 g/L (18 mmol/L in terms of $Cr^{3+}$ ions)

(B) Ammonium hexafluorozirconate: 2.4 g/L (10 mmol/L in terms of Zr ions)

(C) Ammonium nitrate: 12.0 g/L (150 mmol/L in terms of $NO_3^-$ ions)

(D) Chain colloidal silica (diameter of 40-100 nm): 64.0 g/L (160 mmol/L)

The residue is water.

Example 4

A chemical conversion treatment liquid was prepared as specified below, and the pH of the liquid was adjusted to 3.5 with ammonia water. Thereafter, the above test specimen was dipped in the chemical conversion treatment liquid at 40° C. for 20 seconds.

(A) 40% chromium sulfate: 8.8 g/L (18 mmol/L in terms of $Cr^{3+}$ ions)

(B) Potassium fluorozirconate: 2.8 g/L (10 mmol/L in terms of Zr ions)

(C) Ammonium nitrate: 8.0 g/L (100 mmol/L in terms of $NO_3^-$ ions)

(D) Chain colloidal silica (diameter of 40-100 nm): 108.0 g/L (270 mmol/L)

The residue is water.

Example 5

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium nitrate: 11.9 g/L (in terms of $Cr^{3+}$ ion 20 mmol/L, in terms of $NO_3^-$ ion 60 mmol/L)

(B) Ammonium hexafluorozirconate: 1.9 g/L (8 mmol/L in terms of Zr ions)

(C) Cobalt nitrate hexahydrate: 5.0 g/L (17 mmol/L in terms of Co ions and 34 mmol/L in terms of $NO_3^-$ ions)

(D) Sodium nitrate: 7.2 g/L (85 mmol/L in terms of $NO_3^-$ ions)

(E) Chain colloidal silica (diameter of 40-100 nm): 64.0 g/L (160 mmol/L)

The residue is water.

Comparative Example 1

A chemical conversion treatment liquid was prepared as specified below, and the pH of the liquid was adjusted to 3.5 with caustic soda. Thereafter, the above test specimen was dipped in the chemical conversion treatment liquid at 30° C. for 40 seconds.

(A) 40% chromium nitrate: 11.9 g/L (20 mmol/L in terms of Cr and 60 mmol/L in terms of $NO_3^-$ ions)

(B) Ammonium hexafluorozirconate: 2.4 g/L (10 mmol/L in terms of Zr ions)

(C) Sodium nitrate: 3.4 g/L (40 mmol/L in terms of $NO_3^-$ ions)

(D) Spherical colloidal silica (diameter of 10-15 nm): 26.5 g/L (100 mmol/L)

The residue is water.

Comparative Example 2

A chemical conversion treatment liquid was prepared as specified below, and the pH of the liquid was adjusted to 2.0 with caustic soda. Thereafter, the above test specimen was dipped in the chemical conversion treatment liquid at 30° C. for 40 seconds.

(A) 35% chromium chloride: 8.1 g/L (18 mmol/L in terms of $Cr^{3+}$ ions)

(B) Ammonium hexafluorozirconate: 2.2 g/L (9 mmol/L in terms of Zr ions)

(C) Sodium nitrate: 7.2 g/L (85 mmol/L in terms of $NO_3^-$ ions)

(D) Chain colloidal silica (diameter of 40-100 nm): 64.0 g/L (160 mmol/L)

The residue is water.

Comparative Example 3

A chemical conversion treatment liquid was prepared as specified below, and the pH of the liquid was adjusted to 2.5 with caustic soda. Thereafter, the above test specimen was dipped in the chemical conversion treatment liquid at 30° C. for 40 seconds.

(A) 40% chromium nitrate: 47.7 g/L (80 mmol/L in terms of $Cr^{3+}$ ions and 240 mmol/L in terms of $NO_3^-$ ions)

(B) Ammonium hexafluorozirconate: 2.4 g/L (10 mmol/L in terms of Zr ions)

(C) Cobalt nitrate hexahydrate: 5.0 g/L (17 mmol/L in terms of Co ions and 34 mmol/L in terms of $NO_3^-$ ions)

(D) Oxalic acid dihydrate: 3.8 g/L (30 mmol/L in terms of oxalic acid)

Malonic acid: 3.1 g/L (30 mmol/L in terms of malonic acid)

(E) Chain colloidal silica (diameter of 40-100 nm): 48.0 g/L (120 mmol/L)

The residue is water.

Comparative Example 4

A chemical conversion treatment liquid was prepared as specified below, and the pH of the liquid was adjusted to 3.5 with caustic soda. Thereafter, the above test specimen was dipped in the chemical conversion treatment liquid at 40° C. for 30 seconds.

(A) 40% chromium sulfate: 9.8 g/L (20 mmol/L in terms of $Cr^{3+}$ ions)

(B) Ammonium hexafluorozirconate: 2.2 g/L (9 mmol/L in terms of Zr ions)

(C) Cobalt chloride hexahydrate: 4.1 g/L (17 mmol/L in terms of Co ions)

(D) Oxalic acid dihydrate: 3.8 g/L (30 mmol/L in terms of oxalic acid)

Malonic acid: 3.1 g/L (30 mmol/L in terms of malonic acid)

(E) Spherical colloidal silica (diameter of 70-100 nm): 26.5 g/L (100 mmol/L)

The residue is water.

Examples 6 to 10 and Comparative Examples 5 and 6 used, as a zinc-plated test specimen, a matt steel sheet in size of 0.5×50×70 mm plated with zinc in an acidic bath (EZ-985CS manufactured by DIPSOL CHEMICALS Co., Ltd.) in a thickness of 9 to 13 μm. The zinc-plated test specimen was dipped in a 5% nitric acid aqueous solution at room temperature for 10 seconds and then was thoroughly rinsed with running tap water to clean the surface. Next, the zinc-plated test specimen was subjected to the chemical conversion treatment specified below. The test specimen after the chemical conversion treatment was thoroughly washed with tap water and ion exchanged water, and then was placed and dried in the electric drying oven kept at 80° C. for 10 minutes.

Example 6

A chemical conversion treatment liquid was prepared as specified below, and the pH of the liquid was adjusted to 3.5 with ammonia water. Thereafter, the above test specimen was dipped in the chemical conversion treatment liquid at 45° C. for 40 seconds.

(A) 35% chromium chloride: 9.0 g/L (20 mmol/L in terms of $Cr^{3+}$ ions)

(B) Ammonium hexafluorozirconate: 2.4 g/L (10 mmol/L in terms of Zr ions)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Chain colloidal silica (diameter of 40-100 nm): 40.0 g/L (100 mmol/L)

The residue is water.

Example 7

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium sulfate: 8.8 g/L (18 mmol/L in terms of $Cr^{3+}$ ions)

(B) Potassium fluorozirconate: 2.6 g/L (9 mmol/L in terms of Zr ions)

(C) Sodium nitrate: 7.2 g/L (85 mmol/L in terms of $NO_3^-$ ions)

(D) Chain colloidal silica (diameter of 40-100 nm): 64.0 g/L (160 mmol/L)

The residue is water.

Example 8

A chemical conversion treatment liquid was prepared as specified below, and the pH of the liquid was adjusted to 3.5 with ammonia water. Thereafter, the above test specimen was dipped in the chemical conversion treatment liquid at 40° C. for 20 seconds.

(A) 40% chromium sulfate: 8.8 g/L (18 mmol/L in terms of $Cr^{3+}$ ions)

(B) 40% zirconium fluoride: 5.2 g/L (10 mmol/L in terms of Zr ions)

(C) Ammonium nitrate: 8.0 g/L (100 mmol/L in terms of $NO_3^-$ ions)

(D) Chain colloidal silica (diameter of 40-100 nm): 107.9 g/L (270 mmol/L)

The residue is water.

Example 9

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium nitrate: 6.0 g/L (10 mmol/L in terms of $Cr^{3+}$ ions and 30 mmol/L in terms of $NO_3^-$ ions)

(B) Ammonium hexafluorozirconate: 3.6 g/L (15 mmol/L in terms of Zr ions)

(C) Ammonium nitrate: 8.0 g/L (100 mmol/L in terms of $NO_3^-$ ions)

(D) Chain colloidal silica (diameter of 40-100 nm): 64.0 g/L (160 mmol/L)

The residue is water.

Example 10

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 35% chromium chloride: 13.6 g/L (30 mmol/L in terms of $Cr^{3+}$ ions)

(B) Ammonium hexafluorozirconate: 3.6 g/L (15 mmol/L in terms of Zr ions)

(C) Cobalt nitrate hexahydrate: 5.0 g/L (17 mmol/L in terms of Co ions and 34 mmol/L in terms of $NO_3^-$ ions)

(D) Sodium nitrate: 2.6 g/L (30 mmol/L in terms of $NO_3^-$ ions)

(E) Chain colloidal silica (diameter of 40-100 nm): 40.0 g/L (100 mmol/L)

The residue is water.

Comparative Example 5

A chemical conversion treatment liquid was prepared as specified below, and the pH of the liquid was adjusted to 2.0 with caustic soda. Thereafter, the above test specimen was dipped in the chemical conversion treatment liquid at 40° C. for 30 seconds.

(A) 40% chromium nitrate: 23.9 g/L (40 mmol/L in terms of $Cr^{3+}$ ions and 120 mmol/L in terms of $NO_3^-$ ions)

(B) Cobalt nitrate hexahydrate: 5.0 g/L (17 mmol/L in terms of Co ions and 34 mmol/L in terms of $NO_3^-$ ions)

(C) Oxalic acid dihydrate: 1.9 g/L (15 mmol/L in terms of oxalic acid)

Malonic acid: 1.6 g/L (15 mmol/L in terms of malonic acid)

(D) Spherical colloidal silica (diameter of 10-15 nm): 26.5 g/L (100 mmol/L)

The residue is water.

Comparative Example 6

A chemical conversion treatment liquid was prepared as specified below, and the pH of the liquid was adjusted to 3.5 with caustic soda. Thereafter, the above test specimen was dipped in the chemical conversion treatment liquid at 30° C. for 40 seconds.

(A) 35% chromium chloride: 9.0 g/L (20 mmol/L in terms of $Cr^{3+}$ ions)

(B) Cobalt nitrate hexahydrate: 5.0 g/L (17 mmol/L in terms of Co ions and 34 mmol/L in terms of $NO_3^-$ ions)

(C) Malonic acid: 6.2 g/L (60 mmol/L in terms of malonic acid)

(D) Sodium nitrate: 1.7 g/L (20 mmol/L in terms of $NO_3^-$ ions)

(E) Spherical colloidal silica (diameter of 70-100 nm): 26.5 g/L (100 mmol/L)

The residue is water.

Examples 11 and 12 and Comparative Examples 7 and 8 used, as a test specimen plated with zinc-nickel alloy, a matt steel sheet in size of 0.5×50×70 mm plated with a zinc-nickel alloy in a zincate bath (IZ-250 manufactured by DIPSOL CHEMICALS Co., Ltd.) in a thickness of 9 to 10 μm. The test specimen plated with zinc-nickel alloy was subjected to the chemical conversion treatment specified below. The test specimen after the chemical conversion treatment was thoroughly washed with tap water and ion exchanged water, and then was placed and dried in the electric drying oven kept at 80° C. for 10 minutes.

Example 11

A chemical conversion treatment liquid was prepared as specified below, and the pH of the liquid was adjusted to 3.0 with ammonia water. Thereafter, the above test specimen was dipped in the chemical conversion treatment liquid at 40° C. for 60 seconds.

(A) 40% chromium sulfate: 9.8 g/L (20 mmol/L in terms of $Cr^{3+}$ ions)

(B) Ammonium hexafluorozirconate: 3.6 g/L (15 mmol/L in terms of Zr ions)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Chain colloidal silica (diameter of 40-100 nm): 20.0 g/L (50 mmol/L)

The residue is water.

Example 12

A chemical conversion treatment liquid was prepared as specified below, and the pH of the liquid was adjusted to 3.0 with ammonia water. Thereafter, the above test specimen was dipped in the chemical conversion treatment liquid at 40° C. for 60 seconds.

(A) 40% chromium nitrate: 6.0 g/L (10 mmol/L in terms of $Cr^{3+}$ ions and 30 mmol/L in terms of $NO_3^-$ ions)

(B) 40% zirconium fluoride: 10.4 g/L (20 mmol/L in terms of Zr ions)

(C) Ammonium nitrate: 12.0 g/L (150 mmol/L in terms of $NO_3^-$ ions) (D) Chain colloidal silica (diameter of 40-100 nm): 40.0 g/L (100 mmol/L)

The residue is water.

Comparative Example 7

A chemical conversion treatment liquid was prepared as specified below, and the pH of the liquid was adjusted to 3.0 with caustic soda. Thereafter, the above test specimen was dipped in the chemical conversion treatment liquid at 40° C. for 60 seconds.

(A) 40% chromium sulfate: 9.8 g/L (20 mmol/L in terms of $Cr^{3+}$ ions)

(B) Ammonium hexafluorozirconate: 3.6 g/L (15 mmol/L in terms of Zr)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Spherical colloidal silica (diameter of 10-15 nm): 13.3 g/L (50 mmol/L)

The residue is water.

Comparative Example 8

A chemical conversion treatment liquid was prepared as specified below, and the pH of the liquid was adjusted to 4.0 with caustic soda. Thereafter, the above test specimen was dipped in the chemical conversion treatment liquid at 25° C. for 60 seconds.

(A) 35% chromium chloride: 9.0 g/L (20 mmol/L in terms of $Cr^{3+}$ ions)

(B) Cobalt nitrate hexahydrate: 5.0 g/L (17 mmol/L in terms of Co ions and 34 mmol/L in terms of $NO_3^-$ ions)

(C) Sodium nitrate: 3.4 g/L (40 mmol/L in terms of $NO_3^-$ ions)

(D) Oxalic acid dihydrate: 2.5 g/L (20 mmol/L in terms of oxalic acid)

The residue is water.

Examples 13 to 17 and Comparative Examples 9 to 11 used, as a zinc-plated test specimen, a disc brake caliper (material FCD-450) plated with zinc in an acidic bath (EZ-985CS manufactured by DIPSOL CHEMICALS Co., Ltd.) in a thickness of 5 to 25 μm (the thickness varies among portions). The zinc-plated test specimen was dipped in a 5% nitric acid aqueous solution at room temperature for 10 seconds and then was thoroughly rinsed with running tap water to clean the surface. Next, the zinc-plated test specimen was subjected to the chemical conversion treatment specified below. The test specimen after the chemical conversion treatment was thoroughly washed with tap water and ion exchanged water, and then was placed and dried in the electric drying oven kept at 80° C. for 10 minutes.

Example 13

A chemical conversion treatment liquid was prepared as specified below, and the pH of the liquid was adjusted to 3.5 with ammonia water. Thereafter, the above test specimen was dipped in the chemical conversion treatment liquid at 45° C. for 40 seconds.

(A) 35% chromium chloride: 9.0 g/L (20 mmol/L in terms of $Cr^{3+}$ ions)

(B) Ammonium hexafluorozirconate: 2.4 g/L (10 mmol/L in terms of Zr ions)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Chain colloidal silica (diameter of 40-100 nm): 40.0 g/L (100 mmol/L)

The residue is water.

Example 14

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium sulfate: 8.8 g/L (18 mmol/L in terms of $Cr^{3+}$ ions)
(B) Potassium fluorozirconate: 2.6 g/L (9 mmol/L in terms of Zr ions)
(C) Sodium nitrate: 7.2 g/L (85 mmol/L in terms of $NO_3^-$ ions)
(D) Chain colloidal silica (diameter of 40-100 nm): 64.0 g/L (160 mmol/L)

The residue is water.

Example 15

A chemical conversion treatment liquid was prepared as specified below, and the pH of the liquid was adjusted to 3.5 with ammonia water. Thereafter, the above test specimen was dipped in the chemical conversion treatment liquid at 40° C. for 20 seconds.

(A) 40% chromium sulfate: 8.8 g/L (18 mmol/L in terms of $Cr^{3+}$ ions)
(B) 40% zirconium fluoride: 5.2 g/L (10 mmol/L in terms of Zr ions)
(C) Ammonium nitrate: 8.0 g/L (100 mmol/L in terms of $NO_3^-$ ions)
(D) Chain colloidal silica (diameter of 40-100 nm): 107.9 g/L (270 mmol/L)

The residue is water.

Example 16

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 40% chromium nitrate: 11.9 g/L (20 mmol/L in terms of $Cr^{3+}$ ions and 60 mmol/L in terms of $NO_3^-$ ions)
(B) Ammonium hexafluorozirconate: 3.6 g/L (15 mmol/L in terms of Zr ions)
(C) Ammonium nitrate: 8.0 g/L (100 mmol/L in terms of $NO_3^-$ ions)
(D) Chain colloidal silica (diameter of 40-100 nm): 64.0 g/L (160 mmol/L)

The residue is water.

Example 17

A chemical conversion treatment liquid was prepared as specified below, and the pH of the liquid was adjusted to 3.5 with ammonia water. Thereafter, the above test specimen was dipped in the chemical conversion treatment liquid at 40° C. for 30 seconds.

(A) 35% chromium chloride: 13.6 g/L (30 mmol/L in terms of $Cr^{3+}$ ions)
(B) Ammonium hexafluorozirconate: 3.6 g/L (15 mmol/L in terms of Zr ions)

Cobalt nitrate hexahydrate: 5.0 g/L (17 mmol/L in terms of Co ions and 34 mmol/L in terms of $NO_3^-$ ions)

(C) Sodium nitrate: 2.6 g/L (30 mmol/L in terms of $NO_3^-$ ions)
(D) Chain colloidal silica (diameter of 40-100 nm): 40.0 g/L (100 mmol/L)

The residue is water.

Comparative Example 9

A chemical conversion treatment liquid was prepared as specified below, and the pH of the liquid was adjusted to 3.5 with caustic soda. Thereafter, the above test specimen was dipped in the chemical conversion treatment liquid at 30° C. for 40 seconds.

(A) 40% chromium nitrate: 11.9 g/L (20 mmol/L in terms of $Cr^{3+}$ ions and 60 mmol/L in terms of $NO_3^-$ ions)
(B) Ammonium hexafluorozirconate: 2.4 g/L (10 mmol/L in terms of Zr ions)
(C) Sodium nitrate: 3.4 g/L (40 mmol/L in terms of $NO_3^-$ ions)
(D) Spherical colloidal silica (diameter of 10-15 nm): 26.5 g/L (100 mmol/L)

The residue is water.

Comparative Example 10

A chemical conversion treatment liquid was prepared as specified below, and the pH of the liquid was adjusted to 2.0 with caustic soda. Thereafter, the above test specimen was dipped in the chemical conversion treatment liquid at 40° C. for 30 seconds.

(A) 40% chromium nitrate: 23.9 g/L (40 mmol/L in terms of $Cr^{3+}$ ions and 120 mmol/L in terms of $NO_3^-$ ions)
(B) Cobalt nitrate hexahydrate: 5.0 g/L (17 mmol/L in terms of Co ions and 34 mmol/L in terms of $NO_3^-$ ions)
(C) Oxalic acid dihydrate: 1.9 g/L (15 mmol/L in terms of oxalic acid)

Malonic acid: 1.6 g/L (15 mmol/L in terms of malonic acid)

(D) Chain colloidal silica (diameter of 40-100 nm): 40.0 g/L (100 mmol/L)

The residue is water.

Comparative Example 11

A chemical conversion treatment liquid was prepared as specified below, and the pH of the liquid was adjusted to 3.5 with caustic soda. Thereafter, the above test specimen was dipped in the chemical conversion treatment liquid at 30° C. for 40 seconds.

(A) 35% chromium chloride: 9.0 g/L (20 mmol/L in terms of $Cr^{3+}$ ions)
(B) Ammonium hexafluorozirconate: 2.4 g/L (10 mmol/L in terms of Zr ions)
(C) Cobalt chloride hexahydrate: 4.1 g/L (17 mmol/L in terms of Co ions)
(D) Malonic acid: 6.2 g/L (60 mmol/L in terms of malonic acid)
(E) Spherical colloidal silica (diameter of 40-100 nm): 26.5 g/L (100 mmol/L)

The residue is water.

Examples 18 and 19 and Comparative Examples 12 and 13 used, as a test specimen plated with zinc-nickel alloy, a disc brake caliper (material FCD-450) plated with a zinc-nickel alloy in an acidic bath (IZA-2500 manufactured by DIPSOL CHEMICALS Co., Ltd.) in a thickness of 5 to 25 μm (the thickness varies among portions). The test specimen plated with zinc-nickel alloy was subjected to the chemical conversion treatment specified below. The test specimen after the chemical conversion treatment was thoroughly washed with tap water and ion exchanged water, and then was placed and dried in the electric drying oven kept at 80° C. for 10 minutes.

Example 18

A chemical conversion treatment liquid was prepared as specified below, and the pH of the liquid was adjusted to 3.0 with ammonia water. Thereafter, the above test specimen was dipped in the chemical conversion treatment liquid at 40° C. for 60 seconds.

(A) 40% chromium sulfate: 4.9 g/L (10 mmol/L in terms of $Cr^{3+}$ ions)

(B) Ammonium hexafluorozirconate: 1.7 g/L (7 mmol/L in terms of Zr ions)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Chain colloidal silica (diameter of 40-100 nm): 20.0 g/L (50 mmol/L)

The residue is water.

Example 19

A chemical conversion treatment liquid was prepared as specified below, and the pH of the liquid was adjusted to 3.0 with ammonia water. Thereafter, the above test specimen was dipped in the chemical conversion treatment liquid at 40° C. for 60 seconds.

(A) 40% chromium nitrate: 3.0 g/L (5 mmol/L in terms of $Cr^{3+}$ ions and 15 mmol/L in terms of $NO_3^-$ ions)

(B) 40% zirconium fluoride: 5.2 g/L (10 mmol/L in terms of Zr ions)

(C) Ammonium nitrate: 12.0 g/L (150 mmol/L in terms of $NO_3^-$ ions)

(D) Chain colloidal silica (diameter of 40-100 nm): 40.0 g/L (100 mmol/L)

The residue is water.

Comparative Example 12

A chemical conversion treatment liquid was prepared as specified below, and the pH of the liquid was adjusted to 3.0 with caustic soda. Thereafter, the above test specimen was dipped in the chemical conversion treatment liquid at 40° C. for 60 seconds.

(A) 40% chromium sulfate: 4.9 g/L (10 mmol/L in terms of $Cr^{3+}$ ions)

(B) Ammonium hexafluorozirconate: 1.7 g/L (7 mmol/L in terms of Zr ions)

(C) Ammonium nitrate: 12.0 g/L (150 mmol/L in terms of $NO_3^-$ ions)

Zinc nitrate hexahydrate: 0.75 g/L (5 mmol/L in terms of $NO_3^-$ ions)

(D) Spherical colloidal silica (diameter of 10-15 nm): 13.3 g/L (50 mmol/L)

The residue is water.

Comparative Example 13

A chemical conversion treatment liquid was prepared as specified below, and the pH of the liquid was adjusted to 4.0 with caustic soda. Thereafter, the above test specimen was dipped in the chemical conversion treatment liquid at 25° C. for 60 seconds.

(A) 35% chromium chloride: 9.0 g/L (20 mmol/L in terms of $Cr^{3+}$ ions)

(B) Cobalt nitrate hexahydrate: 5.0 g/L (17 mmol/L in terms of Co ions and 34 mmol/L in terms of $NO_3^-$ ions)

(C) Sodium nitrate: 3.4 g/L (40 mmol/L in terms of $NO_3^-$ ions)

(D) Oxalic acid dihydrate: 2.5 g/L (20 mmol/L in terms of oxalic acid)

The residue is water.

The appearance of each of the chemical conversion coatings was evaluated from the viewpoints of color tone, uniformity and gloss. The evaluation criteria for the color tone are as follows.

(Good) Silver white>Blue>Interference color>White (Bad)

The evaluation criteria for the uniformity are as follows.

Good: The trivalent chromium chemical conversion coating was uniformly finished without white haze.

Poor: The trivalent chromium chemical conversion coating was non-uniformly finished with white haze.

A salt spray test (hereinafter referred to as SST) was carried out according to JIS Z-2371 on the test specimens after the chemical conversion treatment, and the corrosion resistance was evaluated by using a white rust generation time and a red rust generation time in units of 24 hours.

Table 1 presents the results of Examples 1 to 5, Table 2 presents the results of Examples 6 to 10, Table 3 presents the results of Examples 11 and 12, Table 4 presents the results of Examples 13 to 17, Table 5 presents the results of Examples 18 and 19, Table 6 presents the results of Comparative Examples 1 to 4, Table 7 presents the results of Comparative Examples 5 and 6, Table 8 presents the results of Comparative Examples 7 and 8, and Table 9 presents the results of Comparative Examples 9 to 13.

TABLE 1

| | | (Unit: mmol/L) Zinc Plating (Zincate Bath) | | | | |
|---|---|---|---|---|---|---|
| [Example] | | 1 | 2 | 3 | 4 | 5 |
| 40% Chromium Nitrate (in terms of $Cr^{3+}$ ions) | | 9 | | | | 20 |
| 35% Chromium Chloride (in terms of $Cr^{3+}$ ions) | | | 20 | | | |
| 40% Chromium Sulfate (in terms of $Cr^{3+}$ ions) | | | | 18 | 18 | |
| Potassium Fluorozirconate (in terms of Zr ions) | | 7 | | | 10 | |
| 40% Zirconium Fluoride (in terms of Zr ions) | | | 15 | | | |
| Ammonium Hexafluorozirconate (in terms of Zr ions) | | | | 10 | | 8 |
| Cobalt Nitrate (in terms of Co ions) | | | | | | 17 |
| Chain Colloidal Silica (Particle Size 40-100 nm) | | 50 | 100 | 160 | 270 | 160 |
| Sodium Nitrate (in terms of $NO_3^-$ ions) | | | 85 | | | 85 |
| Ammonium Nitrate (in terms of $NO_3^-$ ions) | | 60 | | 150 | 100 | |
| Zinc Nitrate (in terms of $NO_3^-$ ions) | | | 5 | | | |
| Total $NO_3^-$ ions | | 87 | 90 | 150 | 100 | 179 |
| $Cr^{3+}$ ions/Zr ions (Molar Ratio) | | 1.29 | 1.33 | 1.80 | 1.80 | 2.50 |
| [Treatment Conditions] | | | | | | |
| pH | | 3.7 | 3.5 | 3.5 | 3.5 | 3.5 |
| Temperature (° C.) | | 35 | 45 | 40 | 40 | 40 |
| Time (Second) | | 60 | 40 | 30 | 20 | 30 |
| [Properties] | | | | | | |
| Appearance | Color Tone | Silver white | Silver white | Silver white | Silver white | Silver white |
| | Uniformity | Good | Good | Good | Good | Good |
| | Gloss | Glossy | Glossy | Glossy | Glossy | Glossy |
| Corrosion Resistance (Salt | White Rust Generation (Hour) | 408 | 456 | 600 | 648 | 648 |

TABLE 1-continued

| [Example] | | (Unit: mmol/L) Zinc Plating (Zincate Bath) 1 | 2 | 3 | 4 | 5 |
|---|---|---|---|---|---|---|
| Spray Test) | Red Rust Generation (Hour) | 888 | 960 | >1000 | >1000 | >1000 |

TABLE 2

| [Example] | | (Unit: mmol/L) Zinc Plating (Acidic Bath) 6 | 7 | 8 | 9 | 10 |
|---|---|---|---|---|---|---|
| 40% Chromium Nitrate (in terms of $Cr^{3+}$ ions) | | | | | 10 | |
| 35% Chromium Chloride (in terms of $Cr^{3+}$ ions) | | 20 | | | | 30 |
| 40% Chromium Sulfate (in terms of $Cr^{3+}$ ions) | | | 18 | 18 | | |
| Potassium Fluorozirconate (in terms of Zr ions) | | | 9 | | | |
| 40% Zirconium Fluoride (in terms of Zr ions) | | | | 10 | | |
| Ammonium Hexafluorozirconate (in terms of Zr ions) | | 10 | | | 15 | 15 |
| Cobalt Nitrate (in terms of Co ions) | | | | | | 17 |
| Chain Colloidal Silica (Particle Size 40-100 nm) | | 100 | 160 | 270 | 160 | 100 |
| Sodium Nitrate (in terms of $NO_3^-$ ions) | | | 85 | | | 30 |
| Ammonium Nitrate (in terms of $NO_3^-$ ions) | | 150 | | 100 | 100 | |
| Zinc Nitrate (in terms of $NO_3^-$ ions) | | 5 | | | | |
| Total $NO_3^-$ ions | | 155 | 85 | 100 | 130 | 64 |
| $Cr^{3+}$ ions/Zr ions (Molar Ratio) | | 2.00 | 2.00 | 1.80 | 0.67 | 2.00 |
| [Treatment Conditions] | | | | | | |
| pH | | 3.5 | 3.5 | 3.5 | 3.5 | 3.5 |
| Temperature (° C.) | | 45 | 40 | 40 | 40 | 40 |
| Time (Second) | | 40 | 30 | 20 | 30 | 30 |
| [Properties] | | | | | | |
| Appearance | Color Tone | Silver white | Silver white | Silver white | Silver white | Silver white |
| | Uniformity | Good | Good | Good | Good | Good |
| | Gloss | Glossy | Glossy | Glossy | Glossy | Glossy |
| Corrosion Resistance (Salt Spray Test) | White Rust Generation (Hour) | 600 | 624 | 528 | 624 | 624 |
| | Red Rust Generation (Hour) | >1000 | >1000 | >1000 | >1000 | >1000 |

TABLE 3

| [Example] | (Unit: mmol/L) Zn—Ni Plating 11 | 12 |
|---|---|---|
| 40% Chromium Nitrate (in terms of $Cr^{3+}$ ions) | | 10 |
| 35% Chromium Chloride (in terms of $Cr^{3+}$ ions) | | |

TABLE 3-continued

| [Example] | (Unit: mmol/L) Zn—Ni Plating 11 | 12 |
|---|---|---|
| 40% Chromium Sulfate (in terms of $Cr^{3+}$ ions) | 20 | |
| Potassium Fluorozirconate (in terms of Zr ions) | | |

TABLE 3-continued

| [Example] | (Unit: mmol/L) Zn—Ni Plating 11 | 12 |
|---|---|---|
| 40% Zirconium Fluoride (in terms of Zr ions) | | 20 |
| Ammonium Hexafluorozirconate (in terms of Zr ions) | 15 | |
| Cobalt Nitrate (in terms of Co ions) | | |

TABLE 3-continued

| [Example] | (Unit: mmol/L) Zn—Ni Plating 11 | 12 |
|---|---|---|
| Chain Colloidal Silica (Particle Size 40-100 nm) | 50 | 100 |
| Sodium Nitrate (in terms of $NO_3^-$ ions) | | |
| Ammonium Nitrate (in terms of $NO_3^-$ ions) | 150 | 150 |
| Zinc Nitrate (in terms of $NO_3^-$ ions) | 5 | |
| Total $NO_3^-$ ions | 155 | 180 |
| $Cr^{3+}$ ions/Zr ions (Molar Ratio) | 1.33 | 0.50 |
| [Treatment Conditions] | | |
| pH | 3.0 | 3.0 |
| Temperature (° C.) | 40 | 40 |
| Time (Second) | 60 | 60 |

TABLE 3-continued

| [Example] | | (Unit: mmol/L) Zn—Ni Plating 11 | 12 |
|---|---|---|---|
| [Properties] | | | |
| Appearance | Color Tone | Silver white | Silver white |
| | Uniformity | Good | Good |
| | Gloss | Glossy | Glossy |
| Corrosion Resistance (Salt Spray Test) | White Rust Generation (Hour) | 792 | 720 |
| | Red Rust Generation (Hour) | >1200 | >1200 |

TABLE 4

| [Example] | | (Unit: mmol/L) Zinc Plating (Acidic Bath) 13 | 14 | 15 | 16 | 17 |
|---|---|---|---|---|---|---|
| 40% Chromium Nitrate (in terms of $Cr^{3+}$ ions) | | | | | 20 | |
| 35% Chromium Chloride (in terms of $Cr^{3+}$ ions) | | 20 | | | | 30 |
| 40% Chromium Sulfate (in terms of $Cr^{3+}$ ions) | | | 18 | 18 | | |
| Potassium Fluorozirconate (in terms of Zr ions) | | | 9 | | | |
| 40% Zirconium Fluoride (in terms of Zr ions) | | | | 10 | | |
| Ammonium Hexafluorozirconate (in terms of Zr ions) | | 10 | | | 15 | 15 |
| Cobalt Nitrate (in terms of Co ions) | | | | | | 17 |
| ChainColloidalSilica (Particle Size 40-100 nm) | | 100 | 160 | 270 | 160 | 100 |
| Sodium Nitrate (in terms of $NO_3$- ions) | | | 85 | | | 30 |
| Ammonium Nitrate (in terms of $NO_3$- ions) | | 150 | | 100 | 100 | |
| Zinc Nitrate (in terms of $NO_3$- ions) | | 5 | | | | |
| Total $NO_3$- ions | | 155 | 85 | 100 | 160 | 64 |
| $Cr^{3+}$ ions/Zr ions (Molar Ratio) | | 2.00 | 2.00 | 1.80 | 1.33 | 2.00 |
| [Treatment Conditions] | | | | | | |
| pH | | 3.5 | 3.5 | 3.5 | 3.5 | 3.5 |
| Temperature (° C.) | | 45 | 40 | 40 | 40 | 40 |
| Time (Second) | | 40 | 30 | 20 | 30 | 30 |
| [Properties] | | | | | | |
| Appearance | Color Tone | Silver white | Silver white | Silver white | Silver white | Silver white |
| | Uniformity | Good | Good | Good | Good | Good |
| | Gloss | Glossy | Glossy | Glossy | Glossy | Glossy |
| Corrosion Resistance (Salt Spray Test) | WhiteRust Generation (Hour) | 336 | 384 | 408 | 504 | 480 |
| | RedRust Generation (Hour) | 792 | 816 | 840 | 936 | 960 |

TABLE 5

| [Example] | | (Unit: mmol/L) 18 | 19 |
|---|---|---|---|
| 40% Chromium Nitrate (in terms of $Cr^{3+}$ ions) | | | 5 |
| 35% Chromium Chloride (in terms of $Cr^{3+}$ ions) | | | |
| 40% Chromium Sulfate (in terms of $Cr^{3+}$ ions) | | 10 | |
| Potassium Fluorozirconate (in terms of Zr ions) | | | |
| 40% Zirconium Fluoride (in terms of Zr ions) | | | 10 |
| Ammonium Hexafluorozirconate (in terms of Zr ions) | | 7 | |
| Cobalt Nitrate (in terms of Co ions) | | | |
| Chain Colloidal Silica (Particle Size 40-100 nm) | | 50 | 100 |
| Sodium Nitrate (in terms of $NO_3^-$ ions) | | | |
| Ammonium Nitrate (in terms of $NO_3^-$ ions) | | 150 | 150 |
| Zinc Nitrate (in terms of $NO_3^-$ ions) | | 5 | |
| Total $NO_3^-$ ions | | 155 | 165 |
| $Cr^{3+}$ ions/Zr ions (Molar Ratio) | | 1.43 | 0.50 |
| [Treatment Conditions] | | | |
| pH | | 3.0 | 3.0 |
| Temperature (° C.) | | 40 | 40 |
| Time (Second) | | 60 | 60 |
| [Properties] | | | |
| Appearance | Color Tone | Silver white | Silver white |
| | Uniformity | Good | Good |
| | Gloss | Glossy | Glossy |
| Corrosion Resistance (Salt Spray Test) | White Rust Generation (Hour) | 720 | 648 |
| | Red Rust Generation (Hour) | >1200 | >1200 |

TABLE 6

| [Comparative Example] | (Unit: mmol/L) Zinc Plating (Zincate Bath) 1 | 2 | 3 | 4 |
|---|---|---|---|---|
| 40% Chromium Nitrate (in terms of $Cr^{3+}$ ions) | 20 | | 80 | |
| 35% Chromium Chloride (in terms of $Cr^{3+}$ ions) | | 18 | | |
| 40% Chromium Sulfate (in terms of $Cr^{3+}$ ions) | | | | 20 |
| Ammonium Hexafluorozirconate (in terms of Zr ions) | 10 | 9 | 10 | 9 |
| Cobalt Nitrate (in terms of Co ions) | | | 17 | |
| Cobalt Chloride (in terms of Co ions) | | | | 17 |
| Oxalic Acid | | | 30 | 30 |
| Malonic Acid | | | 30 | 30 |
| Spherical Colloidal Silica (Particle Size of 10-15 nm) | 100 | | | |
| Spherical Colloidal Silica (Particle Size of 70-100 nm) | | | | 100 |

TABLE 6-continued

| [Comparative Example] | | (Unit: mmol/L) Zinc Plating (Zincate Bath) 1 | 2 | 3 | 4 |
|---|---|---|---|---|---|
| ChainColloidalSilica (Particle Size 40-100 nm) | | | 160 | 120 | |
| Ammonium Nitrate (in terms of $NO_3^-$ ions) | | | | | |
| Zinc Nitrate (in terms of $NO_3^-$ ions) | | | | | |
| Sodium Nitrate (in terms of $NO_3^-$ ions) | | 40 | 85 | | |
| Total $NO_3^-$ ions | | 100 | 85 | 274 | 0 |
| $Cr^{3+}$ ions/Zr ions (Molar Ratio) | | 2.00 | 2.00 | 8.00 | 2.22 |
| [Treatment Conditions] | | | | | |
| pH | | 3.5 | 2.0 | 2.5 | 3.5 |
| Temperature (° C.) | | 30 | 30 | 30 | 40 |
| Time (Second) | | 40 | 40 | 40 | 30 |
| [Properties] | | | | | |
| Appearance | Color Tone | White | Structural Color | Structural Color | White |
| | Uniformity | Poor | Poor | Poor | Poor |
| | Gloss | Less Glossy | Not Glossy | Less Glossy | Not Glossy |
| Corrosion Resistance (Salt Spray Test) | White Rust Generation (Hour) | 168 | 192 | 120 | 168 |
| | Red Rust Generation (Hour) | 360 | 384 | 288 | 384 |

TABLE 7

| [Comparative Example] | (Unit: mmol/L) Zinc Plating (Acidic Bath) 5 | 6 |
|---|---|---|
| 40% Chromium Nitrate (in terms of $Cr^{3+}$ ions) | 40 | |
| 35% Chromium Chloride (in terms of $Cr^{3+}$ ions) | | 20 |
| 40% Chromium Sulfate (in terms of $Cr^{3+}$ ions) | | |
| Ammonium Hexafluorozirconate (in terms of Zr ions) | | |
| Cobalt Nitrate (in terms of Co ions) | 17 | 17 |
| Cobalt Chloride (in terms of Co ions) | | |
| Oxalic Acid | 15 | |
| Malonic Acid | 15 | 60 |
| Spherical Colloidal Silica (Particle Size of 10-15 nm) | 100 | |
| Spherical Colloidal Silica (Particle Size of 70-100 nm) | | 100 |
| Chain Colloidal Silica (Particle Size 40-100 nm) | | |
| Ammonium Nitrate (in terms of $NO_3^-$ ions) | | |
| Zinc Nitrate (in terms of $NO_3^-$ ions) | | |
| Sodium Nitrate (in terms of $NO_3^-$ ions) | | 20 |
| Total $NO_3^-$ ions | 154 | 54 |
| $Cr^{3+}$ ions/Zr ions (Molar Ratio) | — | — |
| [Treatment Conditions] | | |
| pH | 2.0 | 3.5 |
| Temperature (° C.) | 40 | 30 |
| Time (Second) | 30 | 40 |

TABLE 7-continued

| | | (Unit: mmol/L) Zinc Plating (Acidic Bath) | |
|---|---|---|---|
| [Comparative Example] | | 5 | 6 |
| [Properties] | | | |
| Appearance | Color Tone | structural color | White |
| | Uniformity | Poor | Poor |
| | Gloss | Not Glossy | Not Glossy |
| Corrosion Resistance (Salt Spray Test) | White Rust Generation (Hour) | 192 | 168 |
| | Red Rust Generation (Hour) | 384 | 288 |

TABLE 8

| | (Unit: mmol/L) Zn—Ni Plating | |
|---|---|---|
| [Comparative Example] | 7 | 8 |
| 40% Chromium Nitrate (in terms of $Cr^{3+}$ ions) | | |
| 35% Chromium Chloride (in terms of $Cr^{3+}$ ions) | | 20 |
| 40% Chromium Sulfate (in terms of $Cr^{3+}$ ions) | 20 | |
| Ammonium Hexafluorozirconate (in terms of Zr ions) | 15 | |
| Cobalt Nitrate (in terms of Co ions) | | 17 |
| Cobalt Chloride (in terms of Co ions) | | |

TABLE 8-continued

| | | (Unit: mmol/L) Zn—Ni Plating | |
|---|---|---|---|
| [Comparative Example] | | 7 | 8 |
| Oxalic Acid | | | 20 |
| Malonic Acid | | | |
| Spherical Colloidal Silica (Particle Size of 10-15 nm) | | 50 | |
| Spherical Colloidal Silica (Particle Size of 70-100 nm) | | | |
| Chain Colloidal Silica (Particle Size of 40-100 nm) | | | |
| Ammonium Nitrate (in terms of $NO_3^-$ ions) | | 150 | |
| Zinc Nitrate (in terms of $NO_3^-$ ions) | | 5 | |
| Sodium Nitrate (in terms of $NO_3^-$ ions) | | | 40 |
| Total $NO_3^-$ ions | | 155 | 74 |
| $Cr^{3+}$ ions/Zr ions (Molar Ratio) | | 1.4 | — |
| [Treatment Conditions] | | | |
| pH | | 3.0 | 4.0 |
| Temperature (° C.) | | 40 | 25 |
| Time (Second) | | 60 | 60 |
| [Properties] | | | |
| Appearance | Color Tone | White | Blue |
| | Uniformity | Poor | Good |
| | Gloss | Not Glossy | Glossy |
| Corrosion Resistance (Salt Spray Test) | White Rust Generation (Hour) | 720 | 720 |
| | Red Rust Generation (Hour) | >1200 | >1200 |

TABLE 9

| | Zinc Plating (Acidic Bath) | | | Zn—Ni Plating | |
|---|---|---|---|---|---|
| [Comparative Example] | 9 | 10 | 11 | 12 | 13 |
| 40% Chromium Nitrate (in terms of $Cr^{3+}$ ions) | 20 | 40 | | | |
| 35% Chromium Chloride (in terms of $Cr^{3+}$ ions) | | | 20 | | 20 |
| 40% Chromium Sulfate (in terms of $Cr^{3+}$ ions) | | | | 10 | |
| Ammonium Hexafluorozirconate (in terms of Zr ions) | 10 | | 10 | 7 | |
| Cobalt Nitrate (in terms of Co ions) | | 17 | | | 17 |
| Cobalt Chloride (in terms of Co ions) | | | 17 | | |
| oxalic acid | | 15 | | | 20 |
| malonic acid | | 15 | 60 | | |
| SphericalColloidalSilica (Particle Size of 10-15 nm) | 100 | | | 50 | |
| SphericalColloidalSilica (Particle Size of 70-100 nm) | | | 100 | | |
| Chain Colloidal Silica (Particle Size 40-100 nm) | | 100 | | | |
| Ammonium Nitrate (in terms of $NO_3$- ions) | | | | 150 | |
| Zinc Nitrate (in terms of $NO_3$- ions) | | | | 5 | |
| Sodium Nitrate (in terms of $NO_3$- ions) | 40 | | | | 40 |
| Total $NO_3$- ions | 100 | 154 | 0 | 155 | 74 |
| $Cr^{3+}$ ions/Zr ions (Molar Ratio) | 2.00 | — | 2.00 | 1.4 | — |

TABLE 9-continued

| | | Zinc Plating (Acidic Bath) | | | Zn—Ni Plating | |
|---|---|---|---|---|---|---|
| [Comparative Example] | | 9 | 10 | 11 | 12 | 13 |
| [Treatment Conditions] | | | | | | |
| pH | | 3.5 | 2.0 | 3.5 | 3.0 | 4.0 |
| Temperature (° C.) | | 30 | 40 | 30 | 40 | 25 |
| Time (Second) | | 40 | 30 | 40 | 60 | 60 |
| [Properties] | | | | | | |
| Appearance | Color Tone | White | Structural Color | White | White | Blue |
| | Uniformity | Poor | Poor | Poor | Poor | Good |
| | Gloss | Not Glossy | Not Glossy | Not Glossy | Not Glossy | Glossy |
| Corrosion Resistance (Salt Spray Test) | White Rust Generation (Hour) | 192 | 192 | 168 | 720 | 720 |
| | Red Rust Generation (Hour) | 384 | 384 | 288 | >1200 | >1200 |

The invention claimed is:

1. A chemical conversion treatment method of forming a trivalent chromium chemical conversion coating on zinc or zinc alloy plating, the method comprising brining a hexavalent chromium-free trivalent chromium chemical conversion treatment liquid into contact with a base material plated with an acidic zinc or zinc alloy bath, the treatment liquid comprising trivalent chromium ions, zirconium ions, nitrate ions, and chain colloidal silica, wherein the chemical conversion treatment liquid is free of hexavalent chromium and consists of one or more trivalent chromium compounds which provide the trivalent chromium ions, one or more zirconium compounds which provide the zirconium ions, one or more nitric acid compounds which provide the nitrate ions, chain colloidal silica, water, optionally one or more cobalt compounds which provide cobalt ions, optionally one or more fluorine-containing compounds which provide fluoride ions, optionally one or more water-soluble carboxylic acids or salts thereof, optionally one or more water-soluble metal salts containing a metal selected from the group consisting of Zn, Al, Ti, Mo, V, Ce and W, optionally one or more phosphorus compounds, and optionally one or more inorganic acids, one or more organic acids or one or more alkaline agents for adjusting the pH;

the base material is a disc brake caliper;

the pH of the treatment liquid is 2.5 to 5.0; and a molar ratio of trivalent chromium ions to zirconium ions is 0.1 to 4.

2. The method according to claim 1, wherein the treatment liquid has a trivalent chromium ion concentration in a range of 2 mmol/L to 200 mmol/L and a zirconium ion concentration in a range of 1 mmol/L to 300 mmol/L.

3. The method according to claim 1, wherein the treatment liquid has a chain colloidal silica concentration in a range of 25 mmol/L to 600 mmol/L.

4. The method according to claim 1, wherein the treatment liquid has a nitrate ion concentration in a range of 30 mmol/L to 400 mmol/L.

5. The method according to claim 1, wherein the treatment liquid does not contain cobalt ions.

6. The method according to claim 1, wherein the content of trivalent chromium ions in the treatment liquid is 2 mmol/L to 200 mmol/L.

7. The method according to claim 1, wherein the content of zirconium ions in the treatment liquid is 1 mmol/L to 300 mmol/L.

8. The method according to claim 1, wherein the average particle size of the primary particles of the chain colloidal silica is 5 nm to 20 nm.

9. The method according to claim 1, wherein the primary particles of the chain colloidal silica are bound in a link having a length of 20 nm to 200 nm.

10. The method according to claim 1, comprising the cobalt ions in the content of 300 mmol/L or less.

11. The method according to claim 1, comprising the fluoride ions in the content of 6 mmol/L to 1800 mmol/L.

12. The method according to claim 1, comprising the water-soluble carboxylic acids or salts thereof in the content of 0.1 g/L to 10 g/L.

13. The method according to claim 1, comprising the water-soluble metal salts containing a metal selected from the group consisting of Zn, Al, Ti, Mo, V, Ce, and W in the content of 0.1 g/L to 10 g/L.

14. The method according to claim 1, comprising the phosphorus compounds in the content of 0.01 g/L to 1.0 g/L.

15. The method according to claim 1, comprising the cobalt ions in the content of 300 mmol/L or less; and comprising the fluoride ions in the content of 6 mmol/L to 1800 mmol/L; one or more water-soluble carboxylic acids or salts thereof in the content of 0.1 g/L to 10 g/L;

the water-soluble metal salts containing a metal selected from the group consisting of Zn, Al, Ti, Mo, V, Ce, and W in the content of 0.1 g/L to 10 g/L; and the phosphorus compounds in the content of 0.01 g/L to 1.0 g/L.

* * * * *